US011062636B1

(12) United States Patent
Fu

(10) Patent No.: US 11,062,636 B1
(45) Date of Patent: Jul. 13, 2021

(54) METHOD OF CORRECTING SCREEN BRIGHTNESS AND COLOR TEMPERATURE

(71) Applicant: Amlogic (Shanghai) Co., Ltd., Shanghai (CN)

(72) Inventor: Tai Fu, Shanghai (CN)

(73) Assignee: AMLOGIC (SHANGHAI) CO., LTD., Shanghai (CN)

( * ) Notice: Subject to any disclaimer, the term of this patent is extended or adjusted under 35 U.S.C. 154(b) by 414 days.

(21) Appl. No.: 16/326,160

(22) PCT Filed: Sep. 17, 2018

(86) PCT No.: PCT/CN2018/105974
§ 371 (c)(1),
(2) Date: Feb. 15, 2019

(87) PCT Pub. No.: WO2019/062575
PCT Pub. Date: Apr. 4, 2019

(30) Foreign Application Priority Data

Sep. 30, 2017 (CN) ..... 201710944027.X

(51) Int. Cl.
*G09G 5/02* (2006.01)
*G09G 3/20* (2006.01)

(52) U.S. Cl.
CPC ..... *G09G 3/2003* (2013.01); *G09G 3/2007* (2013.01); *G09G 2320/0626* (2013.01); *G09G 2320/0666* (2013.01)

(58) Field of Classification Search
CPC .. G09G 3/2003; G09G 3/2007; G09G 3/3607; G09G 3/3648; G09G 3/3688;
(Continued)

(56) References Cited

U.S. PATENT DOCUMENTS 7,301,618 B2 * 11/2007 Cok ..... G09G 3/3208 315/169.3
7,639,849 B2 * 12/2009 Kimpe ..... G09G 3/20 345/690
(Continued)

FOREIGN PATENT DOCUMENTS

CN 101894541 11/2010
CN 103426393 12/2013
(Continued)

*Primary Examiner* — Vijay Shankar
(74) *Attorney, Agent, or Firm* — Andrew F. Young; Nolte Lackenbach Siegel

(57) ABSTRACT

The present invention discloses a method of correcting screen brightness and color temperature, it relates to the field of display technology. The present invention is used for correcting the working parameters of the every m stages of gray-level pictures to adjust display of the screen to a maximum gray level, the correction is started from a gray level next to the maximum gray level, and only for correction of the first gray level, working parameters of the previous gray level are used as the initial values of working parameters of the current gray level correction; from correction of the second gray level, a correction estimated value of working parameters of a current gray level is estimated according to the working parameters and the local linearity relation of the two corrected gray levels, and the correction estimated value is taken as the initial working parameter of the current gray level correction. The method has the advantages that the method has higher reliability, thereby being capable of effectively correcting different screens or screens nonuniform in quality, and the method has higher accuracy and speed, thereby being capable of completing correction in fewer number of times of adjusting.

11 Claims, 4 Drawing Sheets

Figure 1:
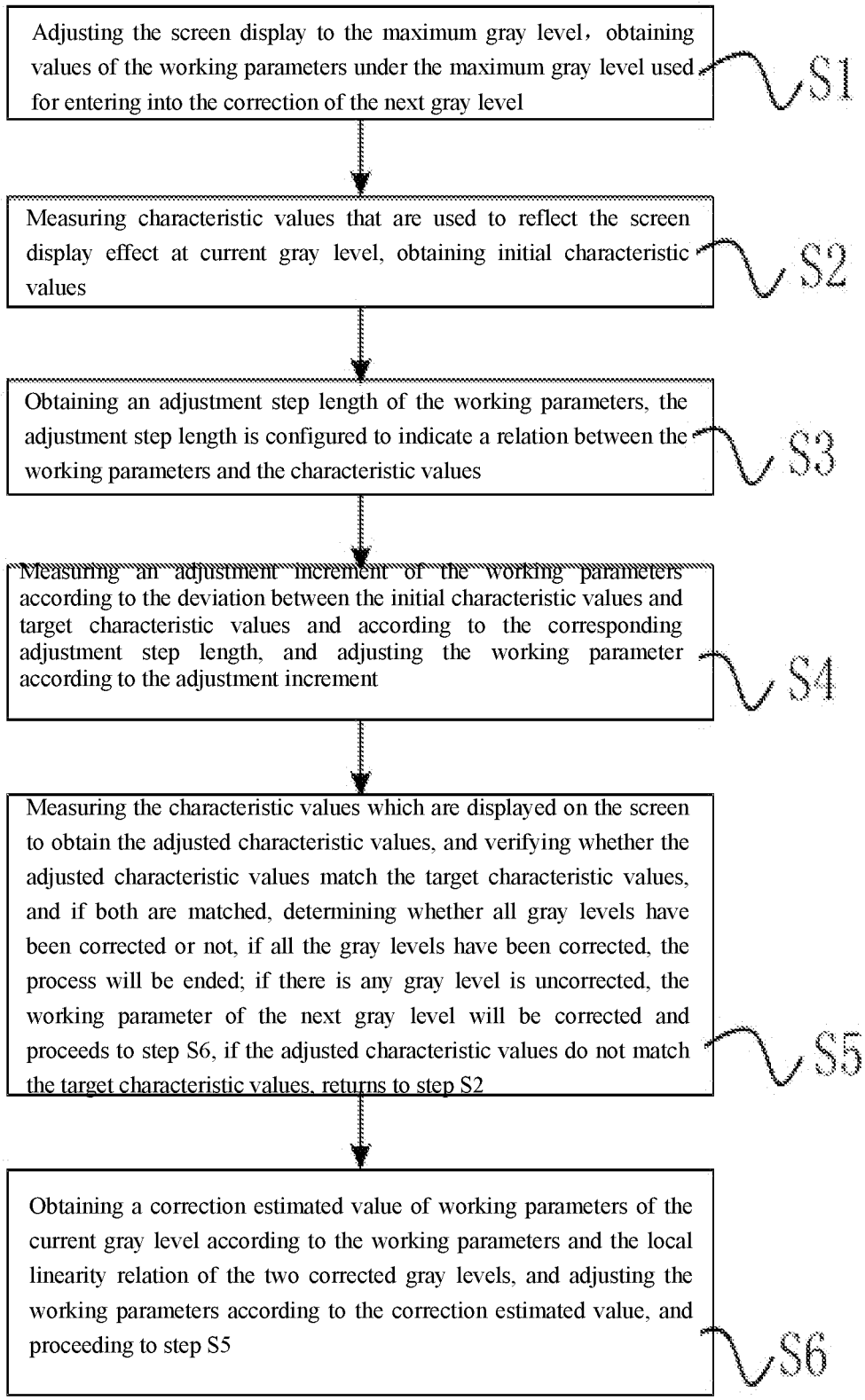

(58) Field of Classification Search
CPC ..... G09G 2320/0666; G09G 2320/06; G09G 2320/062; G09G 2320/0626
See application file for complete search history.

(56) References Cited

U.S. PATENT DOCUMENTS

| | | | | |
|---|---|---|---|---|
| 8,228,348 | B2 * | 7/2012 | Kimpe ..... | G09G 3/2092 345/690 |
| 2011/0025587 | A1 | 2/2011 | Chen | |
| 2018/0204522 | A1 * | 7/2018 | Furihata ..... | G09G 3/3275 |

FOREIGN PATENT DOCUMENTS

| | | |
|---|---|---|
| CN | 103763550 | 4/2014 |
| CN | 105259687 | 1/2016 |

* cited by examiner

METHOD OF CORRECTING SCREEN BRIGHTNESS AND COLOR TEMPERATURE

CROSS-REFERENCE TO RELATED APPLICATIONS

This application is a national phase of Ser. No.: PCT/CN2018/105974 filed Sep. 17, 2018, the entire contents of which is incorporated herein by reference, and which claims priority to and the benefit of Chinese Patent Application No. 201710944027.X filed Sep. 30, 2017.

BACKGROUND OF THE INVENTION

1. Field of the Invention

The invention relates to the field of display technology, more specifically, to a method of correcting screen brightness and color temperature.

2. Description of the Related Art

In the manufacturing process of screens (such as Plasma Display Panel, (as referred to PDP) and liquid crystal displays (as referred to LCD)), the uniformity of the luminous ratios of the primary colors which includes red, green and blue is generally difficult to achieve, and so that the manufacture cannot ensure that the every single display at the factory achieve the best color performance, the manufacture cannot ensure it even for the same brand, the same batch and the same process display. Therefore, it is necessary to correct the color temperature and brightness of the screen in each gray level. The usual method of correction is to adjust the parameters of the three color channels R, G and B under the current gray level, and make the color temperature and brightness of the gray level meet the requirements. For the correction of each gray level, the parameters usually need to be adjusted in several times. In order to ensure that the correction of each gray level is completed efficiently, in the process of each gray level correction, it is necessary to select the appropriate initial RGB value, the adjustment step and the error convergence domain, so that the parameter values of the R, G, and B channels are as close as possible to the corrected value, and the number of adjustments is reduced, thereby reducing the adjusting time.

In the prior art, the RGB value of the previous corrected gray level is usually taken as the initial RGB value of the current gray level correction, there is a problem that the deviation from the corrected result is large and so that the adjustment time becomes longer; or there is also a problem that a preset function generates an initial RGB value of each gray level position which is only applicable to one screen.

SUMMARY OF THE INVENTION

According to the above problems existing in the prior art, the present invention provides a method of correcting screen brightness and color temperature, so as to solve the issue of long adjustment time and the poor reliability during screen brightness and color temperature correction, and the correction method cannot be applied to different screens or uneven screens. The present invention adopts the following technical solutions:

A method of correcting screen brightness and color temperature, used for correcting the working parameters of the every m stages of gray level pictures of the screen, comprising the steps of:

Step S1: adjusting the screen display to the maximum gray level, obtaining values of the working parameters under the maximum gray level used for entering in the correction of the next gray level;

Step S2: measuring characteristic values that are used to reflect the screen display effect at current gray level, obtaining initial characteristic values;

Step S3: obtaining an adjustment step length of the working parameters, the adjustment step length is configured to indicate a relation between the working parameters and the characteristic values;

Step S4: measuring an adjustment increment of the working parameters according to the deviation between the initial characteristic values and target characteristic values and according to the corresponding adjustment step length, and adjusting the working parameter according to the adjustment increment;

Step S5: measuring the characteristic values which are displayed on the screen to obtain the adjusted characteristic values, and verifying whether the adjusted characteristic values match the target characteristic values, and if both are matched, determining whether all gray level have been corrected or not, if all the gray levels have been corrected, the process will be ended; if there is any gray level is uncorrected, the working parameter of the next gray level will be corrected and proceeds to step S6, if the adjusted characteristic values do not match the target characteristic values, returns to step S2;

Step S6: obtaining a correction estimated value of working parameters of the current gray level according to the working parameters and the local linearity relation of the two corrected gray levels, and adjusting the working parameters according to the correction estimated value, and proceed to step S5.

Preferably, in the method of correcting screen brightness and color temperature, the working parameters include the R channel value, G channel value, and B channel value of the screen;

the characteristic values include color temperature coordinates and brightness, the color temperature coordinates include a color temperature x-axis coordinate and a color temperature y-axis coordinate;

the color temperature coordinates are represented by the expression Sx(R, G, B) and the expression Sy(R, G, B), the color temperature x-axis coordinate is represented by the expression Sx(R, G, B), the color temperature y-axis coordinate is represented by the expression Sy(R, G, B);

the brightness is represented by the expression Lv(R,G, B);

R represents an R channel value of the corresponding pixel, G represents a G channel value of the corresponding pixel, and B represents the a B channel value of the corresponding pixel.

Preferably, in the method of correcting screen brightness and color temperature, the adjustment step length in step S3 includes an adjustment step length of R channel, the step of acquiring the adjustment step length of R channel includes the steps of:

Step S311: maintaining the G channel value and the B channel value unchanged, adjusting the R channel value in the deviation direction from the initial color temperature x-axis coordinate to the target color temperature x-axis coordinate by N units, and measuring a debugging color temperature x-axis coordinate which is obtained from the screen display;

Step S312: calculating the adjustment step length of R channel according to the formula $$\nabla_r Sx = \frac{Sx1 - Sx0}{N},$$

wherein the $\nabla_r$Sx represents the adjustment step length of R channel, Sx1 represents the debugging color temperature x-axis coordinate, and Sx0 represents the initial debugging color temperature x-axis coordinate;

Step S313: restoring the R channel value.

Preferably, in the method of correcting screen brightness and color temperature, the adjustment step length in the step S3 includes an adjustment step length of G channel, and the step of acquiring the adjustment step length of G channel includes the steps of:

Step S321: maintaining the R channel value and the B channel value unchanged, adjusting the G channel value in the deviation direction from an initial brightness to the target brightness by N units, and measuring a debugging brightness which is obtained from the screen display;

Step S322: calculating the adjustment step length of G channel according to the formula $$\nabla_g Lv = \frac{Lv1 - Lv0}{N},$$

wherein the $\nabla_g$Lv represents the adjustment step length of G channel, Lv1 represents the debugging brightness, and Lv0 represents the initial brightness;

Step S323: restoring the G channel value.

Preferably, in the method of correcting screen brightness and color temperature, the adjustment step in the step S3 includes an adjustment step length of B channel, and the step of acquiring adjustment step length of B channel includes the steps of:

Step S331: maintaining the R channel value and the G channel value unchanged, adjusting the B channel value in the deviation direction from the initial color temperature y-axis coordinate to the target color temperature y-axis coordinate by N units, and measuring the debugging color temperature y-axis coordinate which is obtained from the screen display;

Step S332: calculating the adjustment step length of B channel according to the formula $$\nabla_b Sy = \frac{Sy1 - Sy0}{N},$$

wherein the $\nabla_b$Sy represents the adjustment step length of B channel, Sy1 represents the debugging color temperature y-axis coordinate, and Sy0 represents the initial color temperature y-axis coordinate;

Step S333: restoring the B channel value.

Preferably, in the method of correcting screen brightness and color temperature, in step S5, the process of verifying whether the adjusted characteristic values match the target characteristic values includes, verifying whether the adjusted color temperature x-axis coordinate matches the target color temperature x-axis coordinate, a verification condition is listed as follow:

$$|Sx2 - Sxt| < K\nabla_r Sx;$$

wherein Sx2 represents the adjusted color temperature x-axis coordinate, Sxt represents the target color temperature x-axis coordinate, K represents the coefficient constant, and $\nabla_r$Sx represents the adjustment step length of R channel.

Preferably, in the method of correcting screen brightness and color temperature, in step S5, the process of verifying whether the adjusted characteristic values match the target characteristic values includes, verifying whether the adjusted brightness matches the target brightness, a verification condition is listed as follow:

$$|Lv2 - Lvt| < K\nabla_g Lv;$$

Wherein Lv2 represents the adjusted brightness, Lvt represents the target brightness, K represents the coefficient constant, and $\nabla_g$Lv represents the adjustment step length of G channel。.

Preferably, in the method of correcting screen brightness and color temperature, in step S5, the process of verifying whether the adjusted characteristic values match the target characteristic values includes, verifying whether the adjusted color temperature y-axis coordinate matches the target color temperature y-axis coordinate, a verification condition is listed as follow:

$$|Sy2 - Syt| < K\nabla_b Sy;$$

wherein Sy2 represents the adjusted color temperature y-axis coordinate, Syt represents the target color temperature y-axis coordinate, K represents the coefficient constant, and $\nabla_b$Sy represents the adjustment step length of B channel.

Preferably, in the method of correcting screen brightness and color temperature, the coefficient constant is equal to 0.5.

The above technical solution has the advantages that the method has higher reliability, thereby being capable of effectively correcting different screens or screens nonuniform in quality, and the method has higher accuracy and speed, thereby being capable of completing correction in fewer number of times of adjusting.

BRIEF DESCRIPTIONS OF THE DRAWINGS

The accompanying drawings, together with the specification, illustrate exemplary embodiments of the present disclosure, and, together with the description, serve to explain the principles of the present invention.

Figure 2:
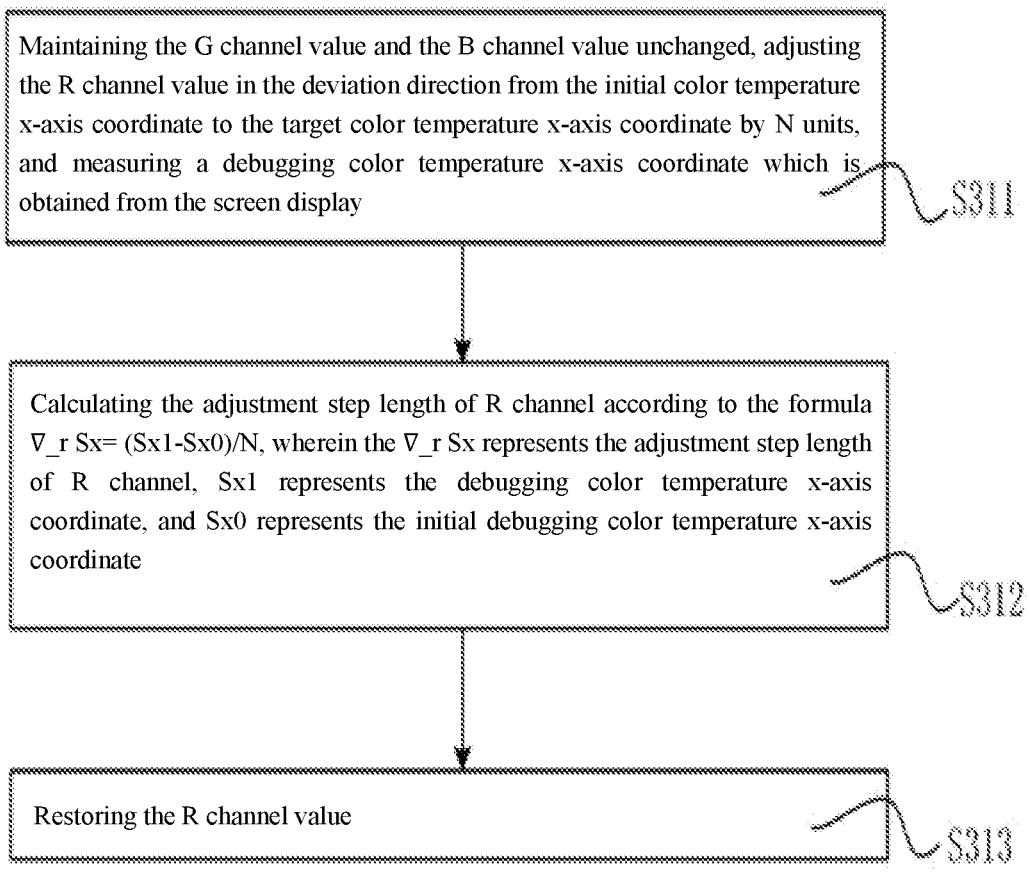
Figure 3:
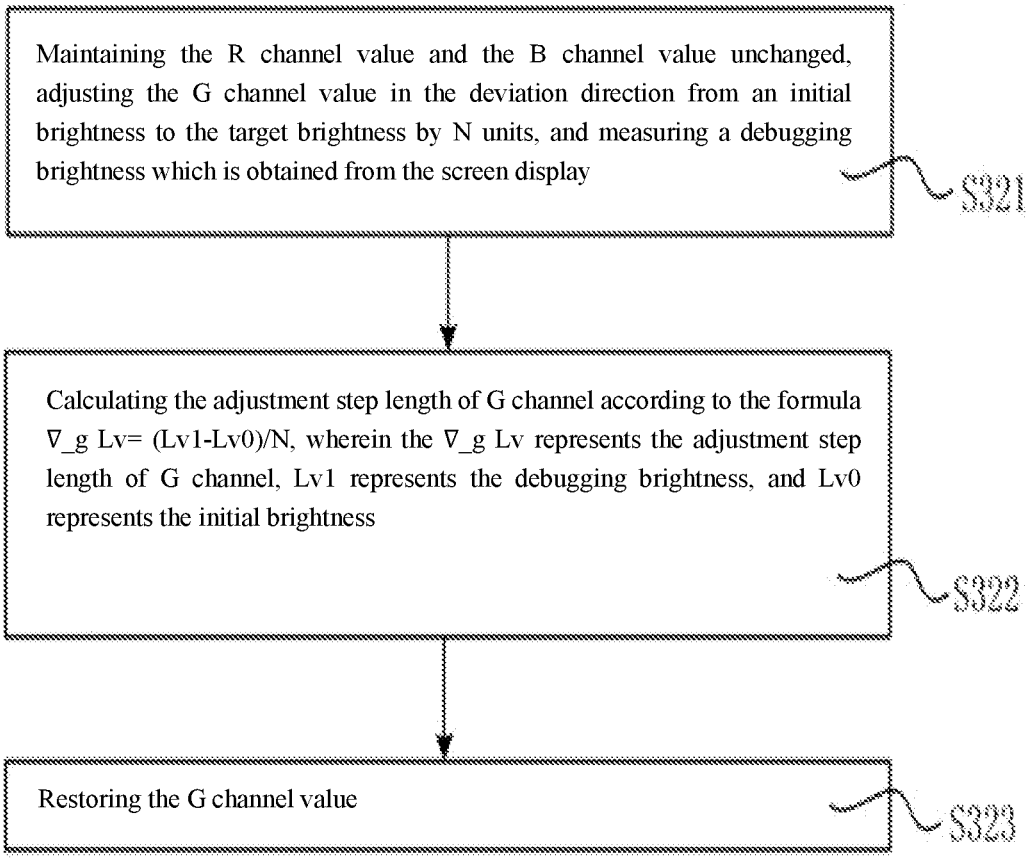
Figure 4:
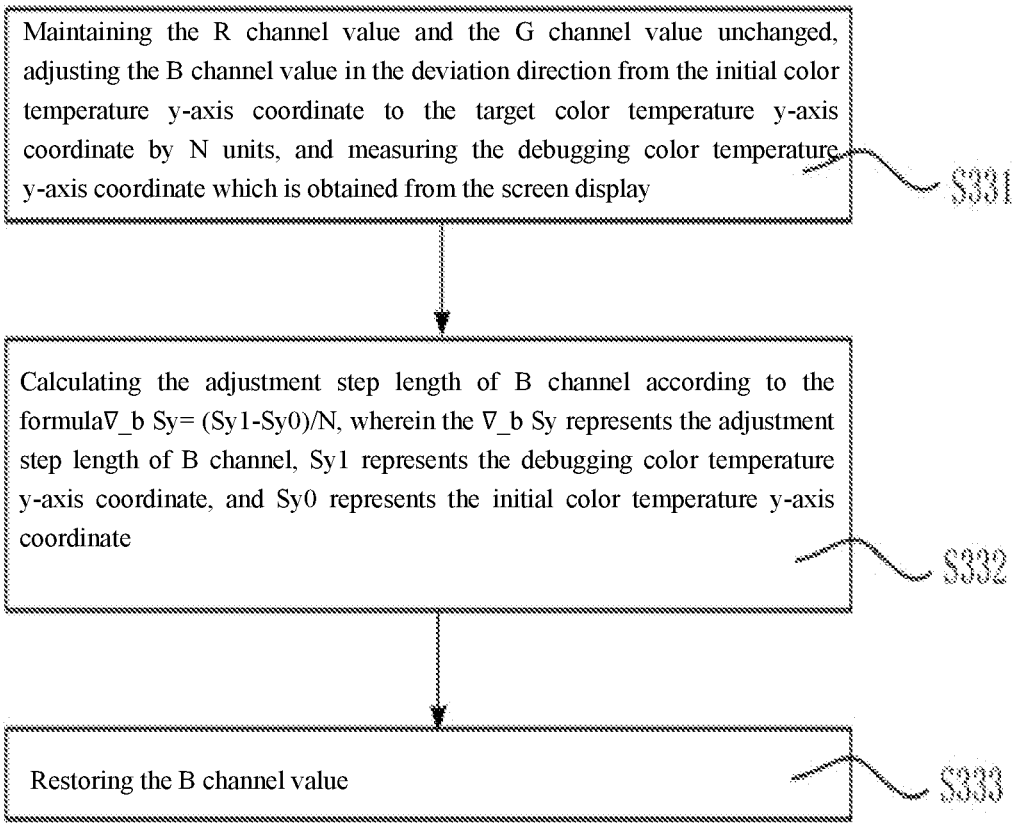

FIGS. 1 to 4 are flow charts of a method of correcting screen brightness and color temperature in a preferred embodiment according to the present invention.

DETAILED DESCRIPTION

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has"

and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the term "plurality" means a number greater than one.

Hereinafter, certain exemplary embodiments according to the present disclosure will be described with reference to the accompanying drawings.

In a preferred embodiment of the present invention, as shown in FIGS. 1 to 4, a method of correcting screen brightness and color temperature is provided, the method is used for correcting the working parameters of every m stages of gray level pictures of the screen, comprising the steps of:

Step S1: adjusting the screen display to the maximum gray level, obtaining values of the working parameters under the maximum gray level used for entering in the correction of the next gray level;

Step S2: measuring characteristic values that are used to reflect the screen display effect at current gray level, obtain initial characteristic values;

Step S3: obtaining an adjustment step length of the working parameters, the adjustment step length is configured to indicate a relation between the working parameters and the characteristic values;

Step S4: measuring an adjustment increment of the working parameters according to the deviation between the initial characteristic values and target characteristic values and according to the corresponding adjustment step length, and adjusting the working parameter according to the adjustment increment;

Step S5: measuring the characteristic values which are displayed on the screen to obtain the adjusted characteristic values, and verifying whether the adjusted characteristic values matches the target characteristic values, and if both are matched, determining whether all gray levels have been corrected or not, if all the gray levels have been corrected, the process will be ended; if there is any gray level is uncorrected, the working parameter of the next gray level will be corrected and proceeds to step S6, if the adjusted characteristic values do not match the target characteristic value, returns to step S2;

Step S6: obtaining a correction estimated value of working parameters of the current gray level according to the working parameters and the local linearity relation of the two corrected gray levels, and adjusting the working parameters according to the correction estimated value, and proceed to step S5.

In a preferred embodiment of the present invention, the working parameters include the R channel value, G channel value, and B channel value of the screen;

the characteristic values include color temperature coordinates and brightness, the color temperature coordinates include a color temperature x-axis coordinate and a color temperature y-axis coordinate;

the color temperature coordinates are represented by the expression Sx(R, G, B) and the expression Sy(R, G, B), the color temperature x-axis coordinate is represented by the expression Sx(R, G, B), the color temperature y-axis coordinate is represented by the expression Sy(R, G, B);

the brightness is represented by the expression Lv(R,G, B);

R represents an R channel value of the corresponding pixel, G represents a G channel value of the corresponding pixel, and B represents a B channel value of the corresponding pixel.

The stage of gray level corresponds to the level of screen brightness. For example, there is a screen with the color depth 8 bit, and has 256 levels of brightness which correspond to 256 stages of gray level, that is, the $0^{th}$ stage, $1^{st}$ stage . . . $255^{th}$ stage of gray levels. Correcting the working parameters of the gray level of display at intervals of m stages, and m is determined according to the calibration speed and accuracy requirements, and m ranges from 0 to n, in which n represents the total numbers of gray level of screen. Further, in this embodiment, m is 0, that is, the color depth is 8-bit, and correcting the working parameters of the screen at each stage of gray level from 0th to 255th, to make the gamma curve of the screen close to a standard gamma curve.

In present embodiment, adjusting the screen to the maximum gray level (the 255th stage of gray level), and the working parameters of the lower gray levels are corrected from the next stage of gray level (the 254th stage of gray level) to the maximum gray level and obtain the working parameters of 255th stage of gray level. The working parameters (R0, G0, B0) of the 255th stage of gray level are taken as the initial values of the working parameters of the 254th stage of gray level picture correction, and the working parameters of the 254th stage of gray level picture are corrected, the characteristic values (the coordinates and brightness of color temperature) of the 254th stage of gray level which is displayed on the screen is measured. The current gray level correction is completed until the measured characteristic values match the characteristic values of corresponding gray level on the standard gamma curve, and the corrected working parameters (R1, G1, B1) of the 254th stage of gray level are obtained, and entering into the correction of the next stage of gray level (the 253th stage of gray level).

Before correcting the 253th stage of gray level, the corrected working parameters (Rx, Gx, Bx) of the 253th stage of gray level are estimated according to the local linear relation between the working parameters (R0, G0, B0) of the 255th stage of gray level and the corrected working parameters (R1, G1, B1) of the 254th stage of gray level, the working parameters of the screen are adjusted according to the correction estimated value (Rx, Gx, Bx), and by step S5, verify whether the correction estimated value (Rx, Gx, Bx) is the target working parameter of the 253th stage of gray level or not. If so, the process of correcting the working parameters of the 253 stage of gray level is completed and the process of correcting the next grays level is launched, if not, the correction estimated values (Rx, Gx, Bx) are taken as the initial values of working parameters of the 253th stage of gray level correction, the working parameters of the 253th of stage of gray level are corrected by the method of steps S2 to S5. The lower stages of gray level are corrected by the method of correcting the 253th stage of gray level. It should be noted that correcting the lower stages of gray levels in sequence from the maximum gray level of the screen is only a preferred embodiment of the present invention, and the process can also be started from the minimum gray level.

In the above technical solution, the correction is started from the next stage of gray level of the maximum gray level, and the working parameters of the previous gray level is taken as the initial value of corrected working parameters of the current gray level only when correcting the first stage of gray level. After the second stage of gray level correction is started, verify whether the characteristic values displayed on the screen match the target characteristic values by estimating the correction estimated value of working parameters of the current gray level and adjusting the working parameters of the screen based on the correction estimated value, and if so, the correction estimated values are the target working parameters of the current gray level, and the working parameters of the current gray level do not need to be adjusted and corrected anymore; if not, the correction estimated values are closer to the target working parameters of the current gray level than to the working parameters of the previous gray level. The correction estimated values being taken as the initial values of working parameters of current gray level correction can reduce the number of times of adjustments of the working parameters for the current gray level correction, and speed up the adjustment speed of the single gray level correction.

In the present embodiment, a sensor is arranged in front of the screen, and the method of correcting each gray level is to measure the initial characteristic values (color temperature coordinate and brightness) displayed on the screen by the sensor at the time when the corrected working parameter of the current gray level is the initial values, the changing relation between the working parameters and the characteristic values are obtained at this time, that is, the adjustment step length of the working parameters is obtained. Dividing the difference value between the target characteristic values of the current gray level and the initial characteristic values by the adjustment step length to obtain the adjusting increment of the working parameters, and adjust the working parameters of the screen according to the adjusting increment. The sensor is used again to measure the adjusted characteristic values of the screen, and then verify whether the adjusted characteristic values match the target characteristic values. The condition that the adjusted characteristic values match the target characteristic values is that the difference value between the two is less than K times the adjustment step length, wherein K is a coefficient constant, and $0<K<1$.

In the above technical solution, calculate the adjustment of the working parameters during correcting according to step length characteristic of the screen itself, to make each adjustment of working parameters appropriate during correcting, and to reduce the number of times of adjustments of the working parameters of single gray level. In addition, the error convergence domain of each adjustment is configured according to the step length characteristic of the screen itself, so as to make it possible for the screen to be corrected under the highest precision. This method of correcting screen brightness and color temperature can effectively correct the different or uneven quality screens.

In a preferred embodiment of the present invention, the adjustment step length in step S3 includes an adjustment step length of R channel, wherein the step of acquiring the adjustment step length of R channel includes the steps of:

Step S311: maintain the G channel value and the B channel value unchanged, adjust the R channel value in the deviation direction from the initial color temperature x-axis coordinate to the target color temperature x-axis coordinate by N units, and measure a debugging color temperature x-axis coordinate which is obtained from the screen display;

Step S312: calculating the adjustment step length of R channel according to the formula $$\nabla_r Sx = \frac{Sx1 - Sx0}{N},$$

wherein the $\nabla_r Sx$ represents the adjustment step length of R channel, Sx1 represents the debugging color temperature x-axis coordinate, and Sx0 represents the initial debugging color temperature x-axis coordinate;

Step S313: restore the R channel value.

In the above technical solution, since the value of the color temperature x-axis coordinate changes little after adjusting the R channel value by one unit, it is not conducive to measure an accurate changing value. Therefore, the average changing value of the color temperature x coordinate is obtained by measuring and calculating after the value of R channel is adjusted by N units. Thereby the R channel adjustment length is obtained, wherein N is a positive integer between 2 and 10. Further, in this embodiment, the value of N is 4.

In a preferred embodiment of the present invention, the adjustment step length in the step S3 includes an adjustment step length of G channel, and the step of acquiring the adjustment step length of G channel includes the steps of:

Step S321: maintain the R channel value and the B channel value unchanged, adjust the G channel value in the deviation direction from an initial brightness to the target brightness by N units, and measure a debugging brightness which is obtained from the screen display;

Step S322: calculate the adjustment step length of G channel according to the formula $$\nabla_g Lv = \frac{Lv1 - Lv0}{N},$$

wherein the $\nabla_g Lv$ represents the adjustment step length of G channel, Lv1 represents the debugging brightness, and Lv0 represents the initial brightness;

Step S323: restore the G channel value.

In the above technical solution, since the value of brightness changes little after adjusting the G channel value by one unit, it is not conducive to measure an accurate changing value. Therefore, the average changing value of brightness is obtained by measuring and calculating after the G channel value is adjusted by N units. Thereby the R channel adjustment length is obtained, wherein N is a positive integer between 2 and 10. Further, in this embodiment, the value of N is 4.

In a preferred embodiment of the present invention, the adjustment step in the step S3 includes an adjustment step length of B channel, and the step of acquiring the adjustment step length of B channel includes the steps of:

Step S441: maintain the R channel value and the G channel value unchanged, adjust the B channel value in the deviation direction from the initial color temperature y-axis coordinate to the target color temperature y-axis coordinate by N units, and measure the debugging color temperature y-axis coordinate which is obtained from the screen display;

Step S332: calculate the adjustment step length of B channel according to the formula $$\nabla_b Sy = \frac{Sy1 - Sy0}{N},$$

wherein the $\nabla_b$Sy represents the adjustment step length of B channel, Sy1 represents the debugging color temperature y-axis coordinate, and Sy0 represents the initial color temperature y-axis coordinate;

Step S333: restore the B channel value.

In the above technical solution, since the value of color temperature y-axis coordinate changes little after adjusting the B channel value by one unit, it is not conducive to measure an accurate changing value. Therefore, the average changing value of color temperature y-axis coordinate is obtained by measuring and calculating after B channel value is adjusted by N units. Thereby B channel adjustment length is obtained, wherein N is a positive integer between 2 and 10. Further, in this embodiment, the value of N is 4

In a preferred embodiment of the present invention, in step S5, the process of verifying whether the adjusted characteristic values match the target characteristic values includes, verifying whether the adjusted color temperature x-axis coordinate matches the target color temperature x-axis coordinate, a verification condition is listed as follow:

$$|Sx2-Sxt|<K\nabla_r Sx;$$

wherein Sx2 represents the adjusted color temperature x-axis coordinate, Sxt represents the target color temperature x-axis coordinate, K represents the coefficient constant, and $\nabla_r$Sx represents the adjustment step length of R channel.

In a preferred embodiment of the present invention, in step S5, the process of verifying whether the adjusted characteristic values match the target characteristic values includes, verifying whether the adjusted brightness matches the target brightness, a verification condition is listed as follow:

$$|Lv2-Lvt|<K\nabla_g Lv;$$

Wherein Lv2 represents the adjusted brightness, Lvt represents the target brightness, K represents the coefficient constant, and $\nabla_g$Lv represents the adjustment step length of G channel.

In a preferred embodiment of the present invention, in step S5, the process of verifying whether the adjusted characteristic values match the target characteristic values includes, verifying whether the adjusted color temperature y-axis coordinate matches the target color temperature y-axis coordinate, a verification condition is listed as follow:

$$|Sy2-Syt|<K\nabla_b Sy;$$

wherein Sy2 represents the adjusted color temperature y-axis coordinate, Syt represents the target color temperature y-axis coordinate, K represents the coefficient constant, and $\nabla_b$Sy represents the adjustment step length of B channel.

In a preferred embodiment of the present invention, the coefficient constant is equal to 0.5。.

Since the R channel value mainly affects the color temperature x-axis coordinate of the screen display, the G channel value mainly affects the brightness of the screen display, and the B channel value mainly affects the color temperature y-axis coordinate of the screen display. Therefore, in this embodiment, the R channel value, the G channel value, and the B channel value are respectively used as the main control objects of the color temperature x-axis coordinate, the brightness, and the color temperature y-axis coordinate, to correct the color temperature coordinates and brightness of each gray level.

The foregoing is only the preferred embodiments of the invention, not thus limiting embodiments and scope of the invention, those skilled in the art should be able to realize that the schemes obtained from the content of specification and figures of the invention are within the scope of the invention.

What is claimed is:

1. A method of correcting screen brightness and color temperature, used for correcting the working parameters of every in stages of gray level pictures of the screen, comprising the steps of:

Step S1: adjusting the screen display to the maximum gray level, obtaining values of the working parameters under the maximum gray level used for entering into the correction of the next gray level;

Step S2: measuring characteristic values that are used to reflect the screen display effect at current gray level, obtaining initial characteristic values;

Step S3: obtaining an adjustment step length of the working parameters, the adjustment step length is configured to indicate a relation between the working parameters and the characteristic values;

Step S4: measuring an adjustment increment of the working parameters according to the deviation between the initial characteristic values and target characteristic values and according to the corresponding adjustment step length, and adjusting the working parameter according to the adjustment increment;

Step S5: measuring the characteristic values which are displayed on the screen to obtain the adjusted characteristic values, and verifying whether the adjusted characteristic values match the target characteristic values, and if both are matched, determining whether all gray levels have been corrected or not, if all the gray levels have been corrected, the process will be ended; if there is any gray level is uncorrected, the working parameter of the next gray level will be corrected and proceeds to step S6, if the adjusted characteristic values do not match the target characteristic values, returns to step S2;

Step S6: obtaining a correction estimated value of working parameters of the current gray level according to the working parameters and the local linearity relation of the two corrected gray levels, and adjusting the working parameters according to the correction estimated value, and proceeding to step S5.

2. The method of correcting screen brightness and color temperature of claim 1, wherein the working parameters include the R channel value, G channel value, and B channel value of the screen;

the characteristic values include color temperature coordinates and brightness, the color temperature coordinates include a color temperature x-axis coordinate and a color temperature y-axis coordinate;

the color temperature coordinates are represented by the expression Sx(R, G, B) and the expression Sy(R, G, B), the color temperature x-axis coordinate is represented by the expression Sx(R, G, B), the color temperature y-axis coordinate is represented by the expression Sy(R, G, B);

the brightness is represented by the expression Lv(R,G, B);

R represents an R channel value of the corresponding pixel, G represents a G channel value of the corresponding pixel, and B represents a B channel value of the corresponding pixel.

3. The method of correcting screen brightness and color temperature of claim 2, wherein the adjustment step length in step S3 includes an adjustment step length of R channel, the step of acquiring the adjustment step length of R channel includes the steps of:

Step S311: maintaining the G channel value and the B channel value unchanged, adjusting the R channel value in the deviation direction from the initial color temperature x-axis coordinate to the target color temperature x-axis coordinate by N units, and measuring a debugging color temperature x-axis coordinate which is obtained from the screen display;

Step S312: calculating the adjustment step length of R channel according to the formula $$\nabla_r Sx = \frac{Sx1 - Sx0}{N},$$

wherein the $\nabla_r$Sx represents the adjustment step length of R channel, Sx1 represents the debugging color temperature x-axis coordinate, and Sx0 represents the initial debugging color temperature x-axis coordinate;

Step S313: restoring the R channel value.

4. The method of correcting screen brightness and color temperature of claim 3, wherein in step S5, the process of verifying whether the adjusted characteristic values match the target characteristic values includes, verifying whether the adjusted color temperature x-axis coordinate matches the target color temperature x-axis coordinate, a verification condition is listed as follow:

$$|Sx2-Sxt|<K\nabla_r Sx;$$

wherein Sx2 represents the adjusted color temperature x-axis coordinate, Sxt represents the target color temperature x-axis coordinate, K represents the coefficient constant, and $\nabla_r$Sx represents the adjustment step length of R channel.

5. The method of correcting screen brightness and color temperature of claim 4, wherein the coefficient constant is equal to 0.5.

6. The method of correcting screen brightness and color temperature of claim 2, wherein the adjustment step length in the step S3 includes an adjustment step length of G channel, and the step of acquiring the adjustment step length of G channel includes the steps of:

Step S321: maintaining the R channel value and the B channel value unchanged, adjusting the G channel value in the deviation direction from an initial brightness to the target brightness by N units, and measuring a debugging brightness which is obtained from the screen display;

Step S322: calculating the adjustment step length of G channel according to the formula $$\nabla_g Lv = \frac{Lv1 - Lv0}{N},$$

wherein the $\nabla_g$Lv represents the adjustment step length of G channel, Lv1 represents the debugging brightness, and Lv0 represents the initial brightness;

Step S323; restoring the G channel value.

7. The method of correcting screen brightness and color temperature of claim 6, wherein in step S5, the process of verifying whether the adjusted characteristic values match the target characteristic values includes, verifying whether the adjusted brightness matches the target brightness, a verification condition is listed as follow:

$$|Lv2-Lvt|<K\nabla_g Lv;$$

Wherein Lv2 represents the adjusted brightness Lvt represents the target brightness, K represents the coefficient constant, and $\nabla_g$Lv represents the adjustment step length of G channel.

8. The method of correcting screen brightness and color temperature of claim 7, wherein the coefficient constant is equal to 0.5.

9. The method of correcting screen brightness and color temperature of claim 2, wherein the adjustment step length in the step S3 includes an adjustment step length of B channel, and the step of acquiring the adjustment step length of B channel includes the steps of:

Step S331: maintaining the R channel value and the G channel value unchanged, adjusting the B channel value in the deviation direction from the initial color temperature y-axis coordinate to the target color temperature y-axis coordinate by N units, and measuring the debugging color temperature y-axis coordinate which is obtained from the screen display;

Step S332: calculating the adjustment step length of B channel according to the formula $$\nabla_b Sy = \frac{Sy1 - Sy0}{N},$$

wherein the $\nabla_b$Sy represents the adjustment step length of B channel, Sy1 represents the debugging color temperature y-axis coordinate, and Sy0 represents the initial color temperature y-axis coordinate;

Step S333: restoring the B channel value.

10. The method of correcting screen brightness and color temperature of claim 9, wherein in step S5, the process of verifying whether the adjusted characteristic values match the target characteristic values includes, verifying whether the adjusted color temperature y-axis coordinate matches the target color temperature y-axis coordinate, a verification condition is listed as follow:

$$|Sy2-Syt|<K\nabla_b Sy;$$

wherein Sy2 represents the adjusted color temperature y-axis coordinate, Syt represents the target color temperature y-axis coordinate, K represents the coefficient constant, and $\nabla_b$Sy represents the adjustment step length of B channel.

11. The method of correcting screen brightness and color temperature of claim 10, wherein the coefficient constant is equal to 0.5.

* * * * *